United States Patent [19]

White

[11] 4,248,220

[45] Feb. 3, 1981

[54] DISPOSABLE DUST RESPIRATOR

[75] Inventor: Willard C. White, Huntington, N.Y.

[73] Assignee: American Cyanamid Company, Stamford, Conn.

[21] Appl. No.: 74,210

[22] Filed: Sep. 10, 1979

Related U.S. Application Data

[63] Continuation-in-part of Ser. No. 926,489, Jul. 20, 1978, abandoned.

[51] Int. Cl.[3] ..... A62B 7/00

[52] U.S. Cl. ..... 128/206.19; 128/206.16; D29/8

[58] Field of Search ..... 128/206.19, 206.16; D29/8, 9; 2/173

[56] References Cited

U.S. PATENT DOCUMENTS

| | | | |
|---|---|---|---|
| Re. 24,549 | 10/1958 | Haliczer | 128/206.19 |
| D. 249,072 | 8/1978 | Revoir | 128/206.16 X |
| 3,603,315 | 9/1971 | Becker | 128/206.19 |
| 3,971,369 | 7/1976 | Aspelin et al. | 128/206.19 |

*Primary Examiner*—Henry J. Recla
*Attorney, Agent, or Firm*—Bruce F. Jacobs

[57] ABSTRACT

A disposable dust respirator which is self-opening and extends away from the mouth to provide more comfortable use.

7 Claims, 3 Drawing Figures

DISPOSABLE DUST RESPIRATOR

CROSS REFERENCE TO RELATED APPLICATIONS

This application is a continuation-in-part of U.S. Ser. No. 926,489, filed July 20, 1978 now abandoned.

This invention relates to disposable dust respirators to provide workers with respiratory protection against pneumoconosis and fibrosis producing dusts. More particularly, the invention is directed to a respirator of this type characterized by its self-opening design, extending away from the mouth when open, ready disposability, low cost, and expanded surface area for extended life.

Filter masks have historically been used to reduce the dispersion of micro-organisms from the respiratory system of medical personnel involved in procedures requiring aseptic conditions, for example, surgery. These masks generally tend to collapse about the nose and mouth of the wearer upon inhalation, particularly after a relatively short period of use when the filter medium has become dampened through the moisture in the exhalant of the wearer. This collapse about the nose and mouth of the wearer is not only uncomfortable and bothersome, but it reduces the filtering efficiency of the mask by forcing a greater volume of air through the smaller surface area of the mask. Also, these masks must be punched or pushed open by the sophisticated doctor or nurse so as to be effective. However, a surgical operation is generally of relative short duration and these drawbacks have not been found too detrimental to use of such masks. Examples of such masks are disclosed in U.S. Pat. Nos. 3,971,369, 3,884,227, 3,736,928, 3,613,678, and others, such as Re. 24,549.

The recent requirements by the National Institute for Occupational Safety and Health (NIOSH) for dust respirators for industrial workers who are exposed to pneumoconiosis and fibrosis producing dusts has meant that relatively unsophisticated people must use masks for extended periods of time. As such, the drawbacks of the previous surgical masks become important and must be overcome so that a worker will not endanger himself by not wearing his mask. One attempt at such a mask is disclosed in U.S. Design Pat. No. 249,072. However, this mask must still be punched open to be useful.

Accordingly, it is an object of this invention to provide a dust respirator having none of the disadvantages of the conventional masks noted above.

A further object is to provide a dust respirator which is designed to automatically open to its maximum filter area merely by fitting the respirator to the face.

A further object is to provide a dust respirator which has a universal anatomical fit which is comfortable to wear.

These and other objects and features of the present invention will become more fully apparent from the following description and claims taken in conjunction with the accompanying drawing.

The invention is best understood by reference to the figures wherein like parts are designated with like numerals throughout.

Figure 1:
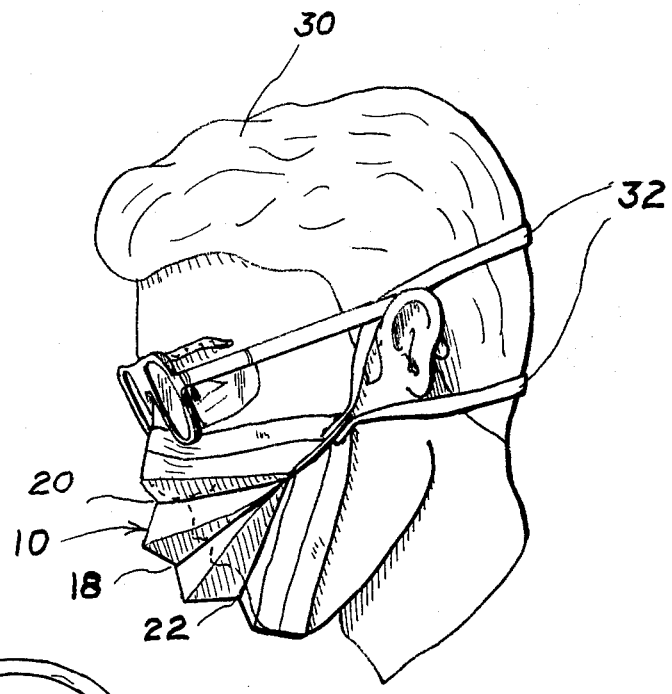
FIG. 1 is a view of a dust respirator as it appears when worn.
Figure 2:
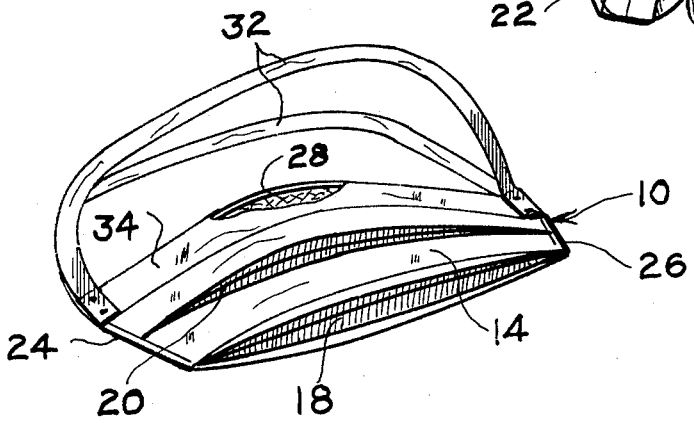
FIG. 2 is a perspective view seen from the bottom of the dust respirator of FIG. 1 in its partially open state with the top portion thereof shown partly broken away and in section.
Figure 3:
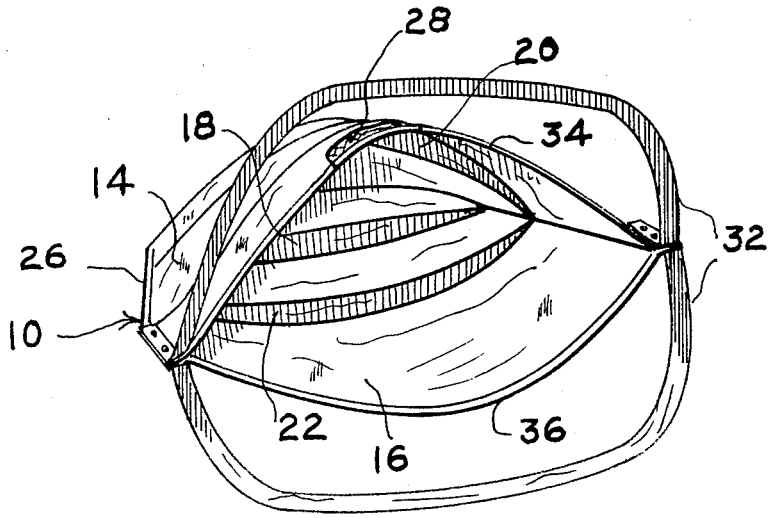
FIG. 3 is a perspective view of the dust respirator of FIG. 1 in its open state, as seen from the top.

Referring to the embodiment of FIGS. 1-3, the dust respirator is shown generally at 10 and is fabricated from a generally planar segment of filter medium having a horizontal and a vertical dimension. The filter medium is folded in the horizontal direction to form opposed faces 14 and 16, and to have at least one pleat 18 central to the opposed faces, which foreshortens the filter medium in the vertical dimension. Preferably, there is either one or three central pleats. Each of the opposed faces 14 and 16 has at least one additional pleat 20 and 22 which further foreshorten the filter medium in the vertical dimension. All of the pleats are latarally extending and are joined at the borders 24 and 26 of the dust respirator by a suitable means, such as by heat sealing.

The pleats are arranged such that the central pleat or pleats 18 is or are shorter in the horizontal direction than the additional pleast 20 and 22, which, in turn, are shorter in the horizontal direction than the maximum horizontal dimension of the filter medium. This arrangement means that the borders 24 and 26 are tapered away from the opening of the respirator. As a result of this arrangement of pleats 18,20 and 22, the respirator is self-expanding upon opening and there is no need for the wearer to "punch out" a breathing pocket each time the respirator is used.

The upper border of the filter medium includes a conventional yieldably deformable strip 28 which serves to selectively conform the upper border of the filter medium to the nasal contour of wearer 30. As shown in FIGS. 2 and 3, the strip 28 is preferably embedded in opposed face 14 though it may be on the surface thereof. Preferably the strip is a wire reinforced plastic strip.

The respirator 10 is provided with attachment means 32 for releasably securing it to the wearer 30. Preferably, elastic straps are used to provide comfort around the ears of the wearer.

The external configuration of respirator 10 is preferably completed by double foldovers 34 and 36 across the lower and upper borders respectively.

Referring now more particularly to FIG. 3, the dust respirator 10 is self-expanding into its open useable state by merely pulling the upper and lower borders of the respirator. When the respirator is not in use, it is readily stored in its original flat configuration.

As a result of the design of the respirator, it is possible to have a relatively large filter surface area which is available for filtration without the need for the wearer to do other than pull the elastic straps and place the device over his mouth and nose, while at the same time being collapsible into a relatively confined dimensional configuration for ease of storage, shipment, handling etc.

Preferably the filter medium 12 has an original surface area of about 70–75 square inches so as to provide a respirator having sufficient service life to satisfy the requirements of the National Institute for Occupational Safety and Health.

The invention may be embodied in other specific forms without departing from its spirit or essential characteristics. The described embodiments are to be considered in all respects only as illustrative and not restrictive and the scope of the invention is, therefore, indicated by the appended claims rather than the foregoing description.

What is claimed is:

1. A dust respirator adapted to be worn upon the face of a wearer, the respirator comprising:

a. an initially generally planar surface of filter medium, having a vertical and a horizontal dimension, being centrally folded in the horizontal direction to form upper and lower opposed faces; having at least one horizontal pleat essentially central to said opposed faces to foreshorten the filter medium in the vertical dimension, having at least one additional horizontal pleat in each of said opposed faces wherein said central pleat together with said pleats in the opposed faces form a self-supporting pocket, wherein the central pleat is shorter in the horizontal dimension relative to the pleats in the opposed faces which are each shorter in the horizontal dimension relative to the maximum horizontal dimension of the filter medium, having the opposed faces joined vertically at the extreme ends of each of said pleats;

b. a yieldable deforming conforming means horizontally extending at least partially across the upper opposed face capable of conforming the opposed face to the nasal contour of the wearer; and c. attachment means for releasably securing the respirator upon the face of the wearer.

2. The dust respirator of claim 1 wherein there is one central pleat.

3. The dust respirator of claim 1 wherein there are three central pleats.

4. The dust respirator of claim 1 wherein each of the opposed faces has one pleat.

5. The dust respirator of claim 1 wherein the filter medium has an initial surface area of about 70–75 square inches.

6. The dust respirator of claim 1 wherein the yieldable deforming conforming means is embedded in the opposed face.

7. The dust respirator of claim 1 wherein the joining of the opposed faces is a heat seal.

* * * * *